US006231399B1

(12) United States Patent
Meng

(10) Patent No.: US 6,231,399 B1
(45) Date of Patent: May 15, 2001

(54) CARD EDGE CONNECTOR ASSEMBLY

(75) Inventor: Ching-Chang Meng, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/337,165

(22) Filed: Jun. 21, 1999

(30) Foreign Application Priority Data

Jan. 12, 1999 (TW) ..... 88200437

(51) Int. Cl.[7] ..... H01R 13/502

(52) U.S. Cl. ..... 439/701; 439/79

(58) Field of Search ..... 439/74, 79, 567, 439/701, 541.5

(56) References Cited

U.S. PATENT DOCUMENTS

| | | | | |
|---|---|---|---|---|
| 4,756,695 | * | 7/1988 | Lane et al. | 439/76 |
| 5,882,211 | * | 3/1999 | Choy et al. | 439/74 |
| 6,027,370 | * | 2/2000 | Hsu et al. | 439/541.5 |
| 6,062,892 | * | 5/2000 | Meng et al. | 439/357 |
| 6,074,248 | * | 6/2000 | Huang | 439/541.5 |

* cited by examiner

*Primary Examiner*—Khiem Nguyen
(74) *Attorney, Agent, or Firm*—Wei Te Chung

(57) ABSTRACT

A card edge connector assembly mounted on a mother board comprises a dielectric bracket and first and second card edge connectors. The bracket has a center wall, a pair of side walls, and a pair of top plates. Two receiving spaces are defined between the side walls on opposite sides of the center wall for retaining the first and second card edge connectors.

10 Claims, 8 Drawing Sheets

CARD EDGE CONNECTOR ASSEMBLY

BACKGROUND OF THE INVENTION

The present invention relates to a connector assembly, and particularly to a connector assembly which stacks at least two card edge connectors together thereby promoting an efficient use of space of a mother board to which the connector assembly is connected.

Card edge connectors are commonly used in computers for providing electrical connection between a mother board and a daughter board. Conventional card edge connectors are usually individually mounted on the mother board. However, due to the miniaturization trend of computers, space on a mother board is limited. Furthermore, the daughter board is horizontally inserted into or ejected out of a card edge connector proximate the mother board to which the connector is mounted. Such a low position of the daughter board interferes with an efficient layout of components on the mother board. Thus, an assembly of two or more card edge connectors which engage daughter boards at an elevated position is desirable.

SUMMARY OF THE INVENTION

Accordingly, a primary object of the present invention is to provide a card edge connector assembly which stacks two or more card edge connectors together.

A second object of the present invention is to provide a card edge connector assembly which engages daughter boards at an elevated position for promoting an efficient layout of components on a mother board.

To fulfill the above-mentioned objects, a card edge connector assembly comprises a dielectric bracket for retaining at least two card edge connectors. The bracket forms two receiving spaces for retaining two card edge connectors on opposite sides thereof. The card edge connectors received in the bracket are distanced from a mother board to which the card edge connector assembly is connected; therefore, a daughter board received in the card edge connector will not interfere with a layout of electronic components on the mother board.

DETAILED DESCRIPTION OF THE INVENTION

Figure 1:
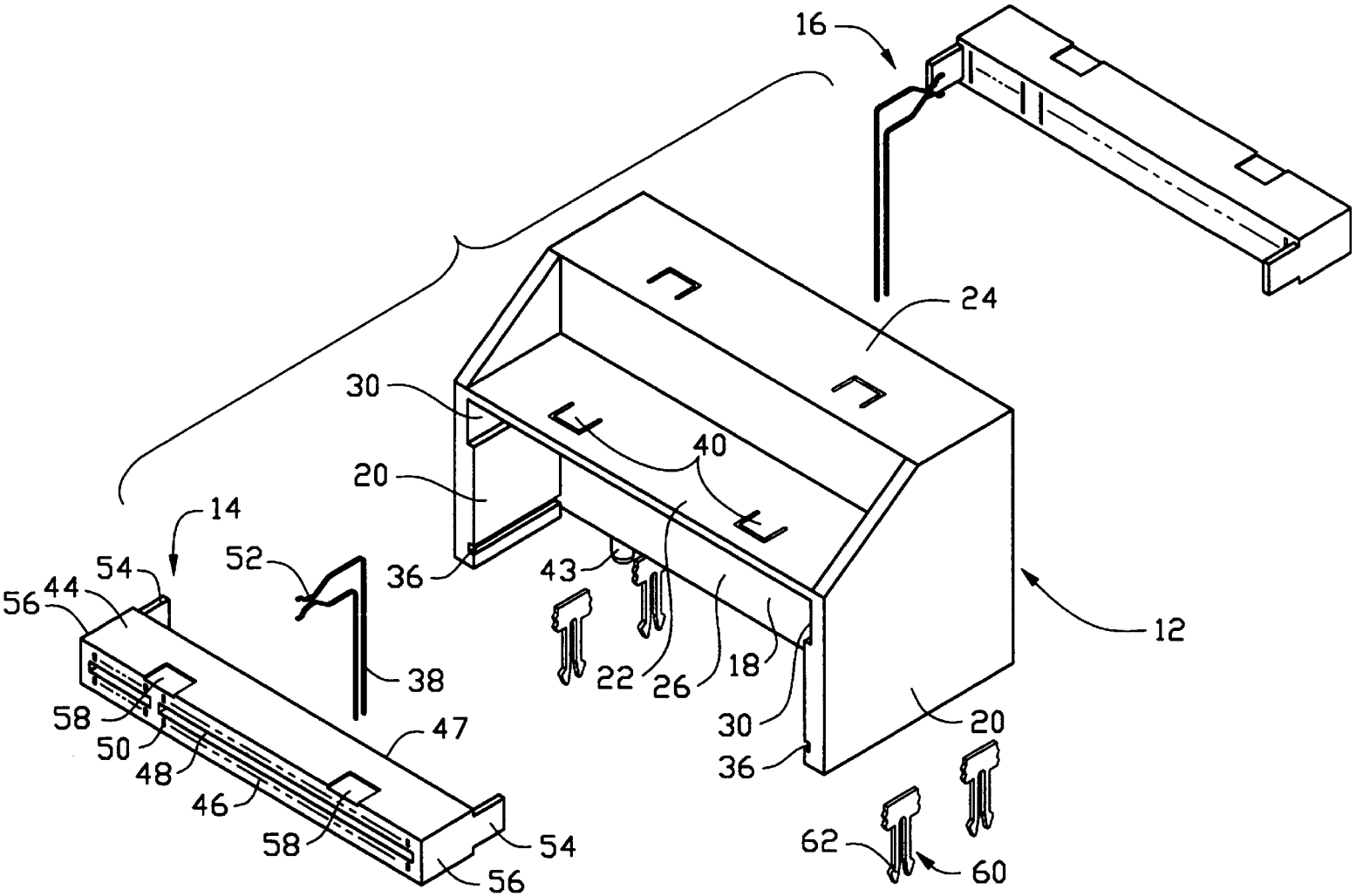
FIG. 1 is an exploded view of a card edge connector assembly of the present invention.

Referring to FIGS. 1, 7, 8 and 9, a card edge connector assembly 10 comprises a dielectric bracket 12 for retaining first and second card edge connectors 14, 16. The bracket 12 has a center wall 18, a pair of side walls 20 and a pair of top plates 22, 24. The side walls 20, the center wall 18 and the top plate 22 cooperate to define a first receiving space 26 therebetween. The side walls 20, the center wall 18 and the top plate 24 cooperate to define a second receiving space 28 therebetween. The top plate 24 is positioned higher than the top plate 22.

Figure 3:
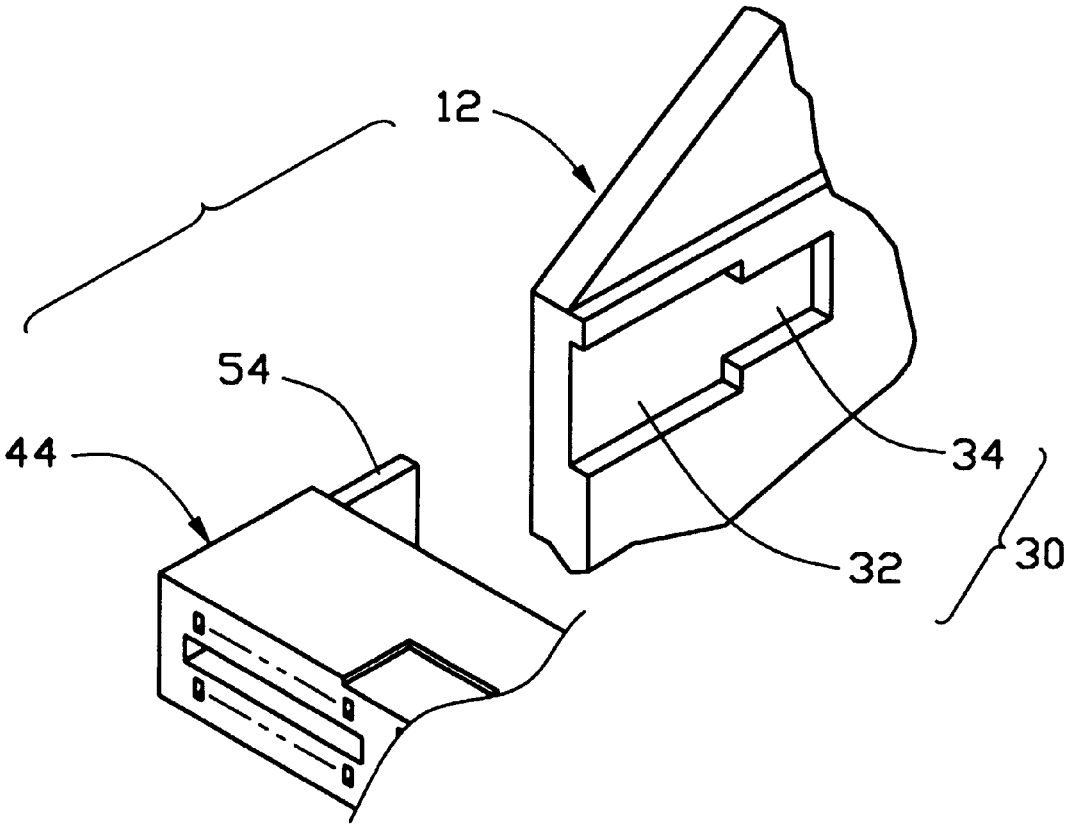
FIG. 3 is an enlarged, partially cut-away exploded view of the first card edge connector and a recess of a bracket for retaining the first card edge connector.
Figure 4:
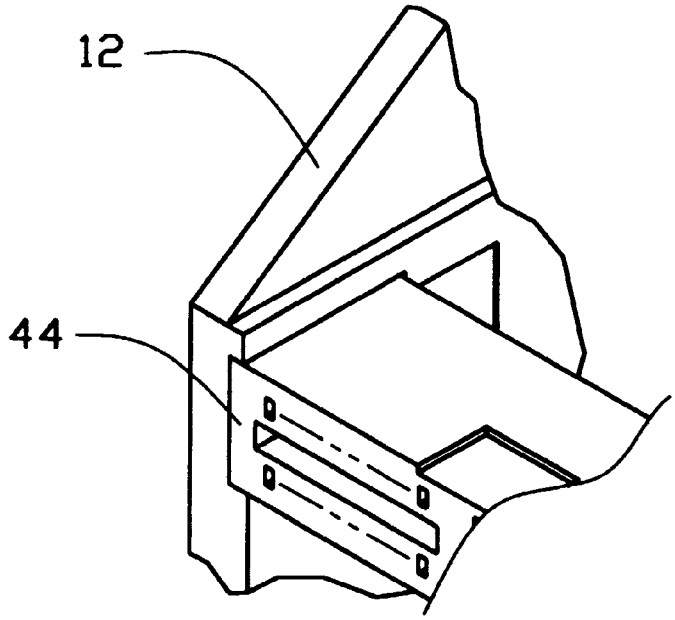
FIG. 4 is an assembled view of FIG. 3.
Figure 5:
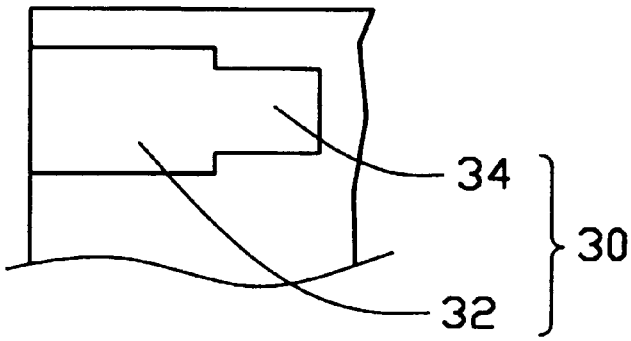
FIG. 5 is a side view of the recess in FIG. 3.
Figure 6:
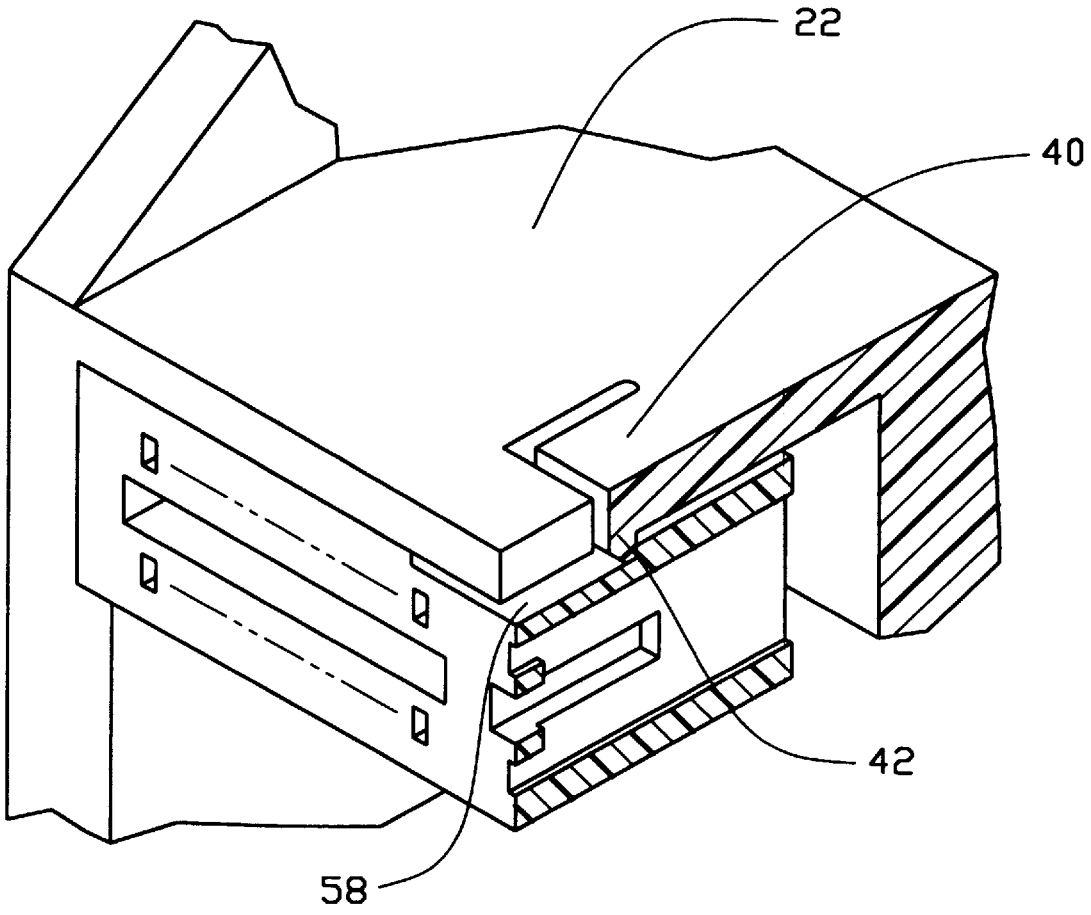
FIG. 6 is a partially cut-away perspective view of the card edge connector assembly showing the first card edge connector secured in the bracket.
Figure 7:
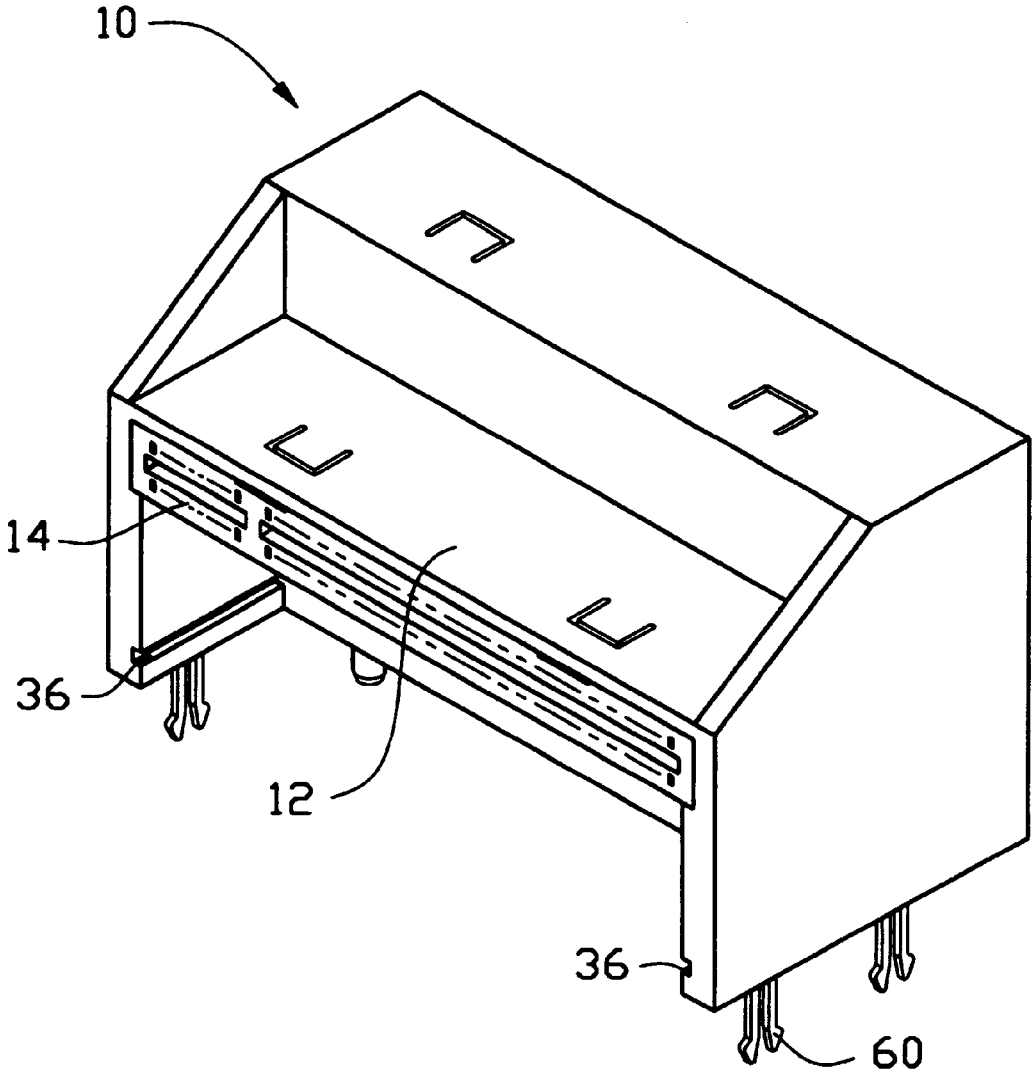
FIG. 7 is an assembled view of FIG. 1.
Figure 8:
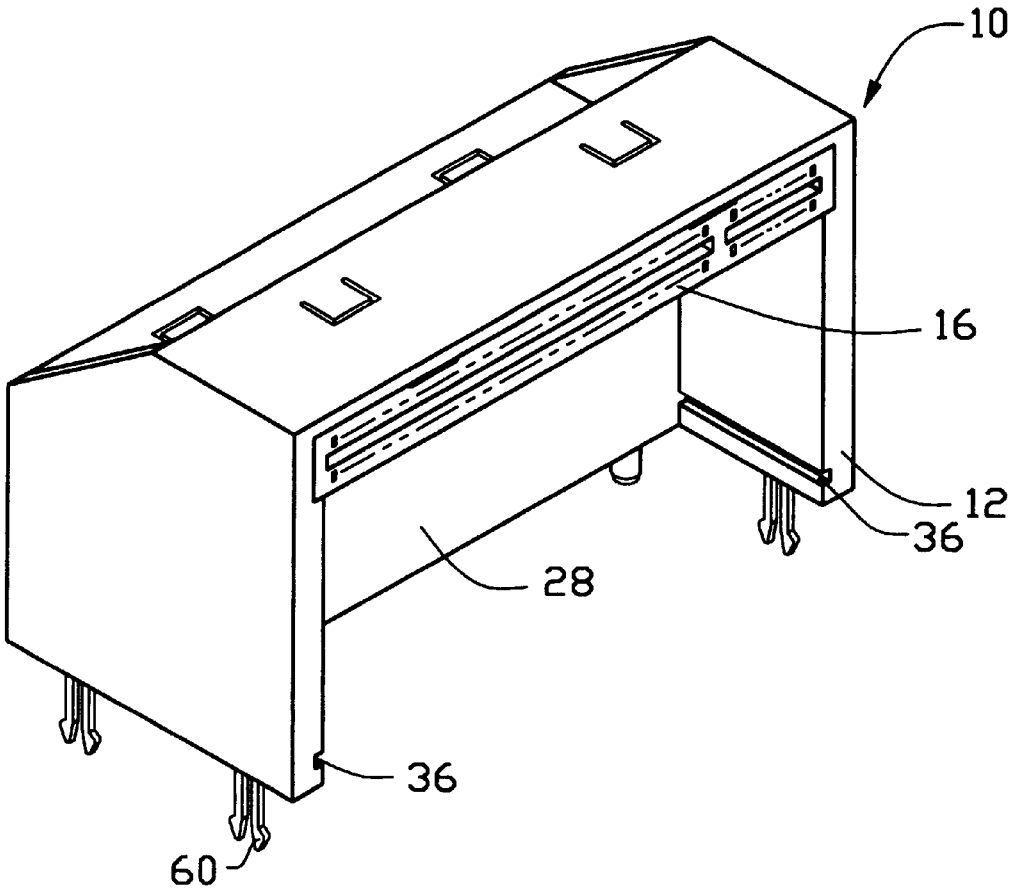
FIG. 8 is similar to FIG. 7 taken from a different perspective.
Figure 9:
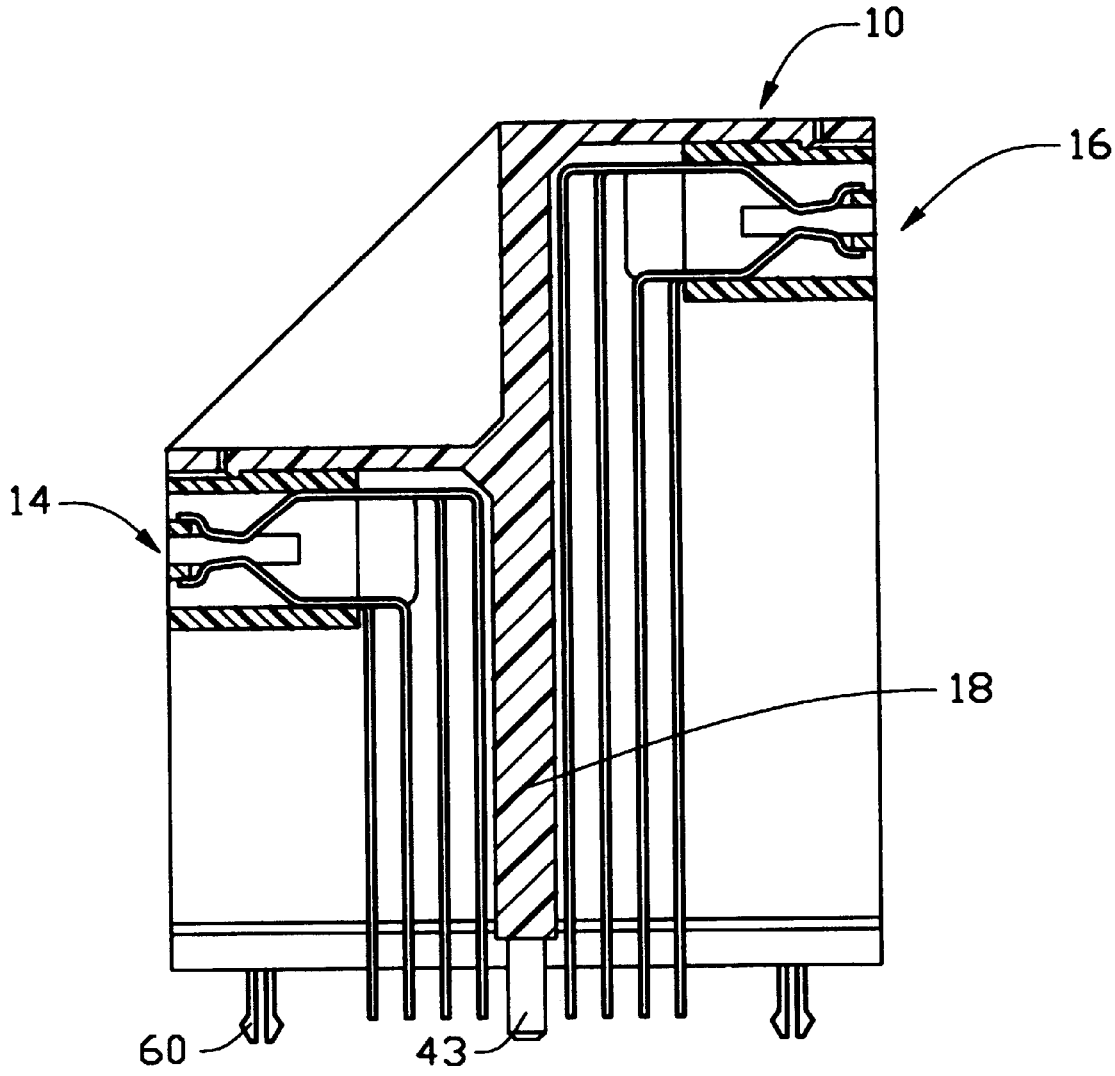
FIG. 9 is cross-sectional view of FIG. 7.

As illustrated in the FIGS. 3, 4 and 5 wherein, for clarity, the top plate 22 is removed, in the first receiving space 26, each side wall 20 defines a groove 30 having a wide portion 32 and a narrow portion 34 for guiding and retaining the first card edge connector 14. The groove 30 is proximate the top plate 22. Referring back to FIG. 1, a pair of lower channels 36 is defined in the side walls 20 for retaining a spacer (not shown) used for extension of tail portions of terminals 38 of the first card edge connector 14 therethrough whereby the tail portions are spaced from each other a predetermined distance. Also referring to FIG. 6, two cantilevered hooks 40 are formed in the top plate 22 wherein each hook 40 is provided with a desired degree of resiliency. Each hook 40 forms a projection portion 42 for engaging the first card edge connector 14.

Since the structure and function of the second receiving space 28, including the side walls 20 and the top plate 24, is similar to the first receiving space 28, a detailed description thereof is omitted herein. A polarizing post 43 extends downwardly from the center wall 18 for guiding the bracket 12 to mount on a mother board (not shown).

Figure 2:
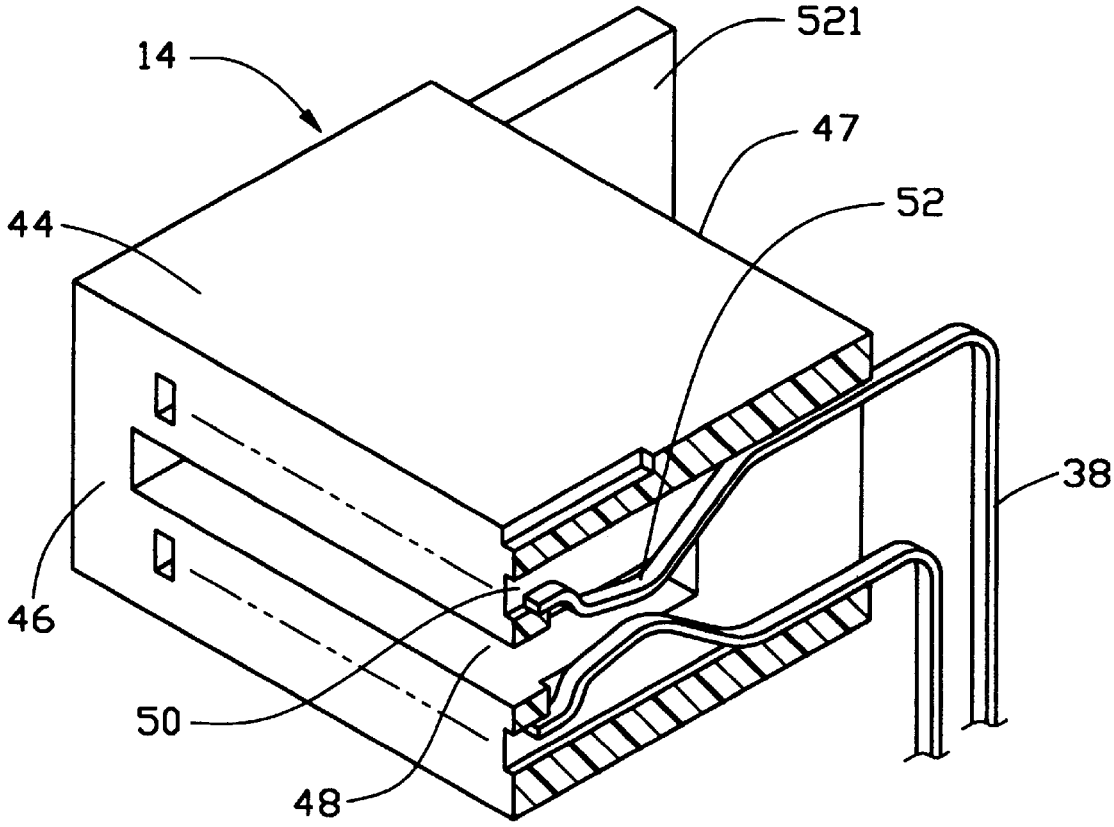
FIG. 2 is a perspective, cut-away view of a first card edge connector showing terminals mounted therein.

Referring to FIGS. 1 and 2, the first card edge connector 14 includes an elongate housing 44 and a plurality of terminals 38 retained therein. The housing 44 has a mating face 46 and a mounting face 47 opposite the mating face 46. An elongate card receiving slot 48 is defined in the housing 44. A plurality of terminal passageways 50 is defined in opposite sides of the slot 46 between the mating face 46 and the mounting face 47 for receiving the terminals 38 therein. The passageways 50 are partially exposed to the slot 48. Each terminal 38 has a curved portion 52 projecting into the slot 48 for contacting an electrical pad on a daughter board (not shown) inserted into the slot 48. The terminals 38 are formed and stamped to have a right-angled structure.

A pair of engagement projections 54 rearwardly extends from opposite ends 56 of the housing 44 and is adapted to be inserted in the narrow portion 34 of the groove 30. In addition, the housing 44 is dimensioned to be snugly received in the wide portion 32 of the groove 30. A pair of recesses 58 is defined on a top of the housing 44 proximate the mating face 46 for engaging the projection portions 42 of the hooks 40 of the bracket 12. Thus, the first card edge connector 14 is retained in the bracket 12.

Since the structure and function of the second card edge connector 16 is similar to the first card edge connector 14, a detailed description thereof is omitted herein.

The card edge connector assembly 10 further comprises four boardlocks 60 mounted in bottom surfaces of the side walls 20 for securing the assembly 10 to the mother board. Each boardlock 60 includes a pair of securing legs 62 for insertion in through holes of the mother board. It is noted that screws may be used to serve the same function as the boardlocks 60.

The two card edge connectors 14, 16 of the card edge connector assembly 10 engage daughter boards at an elevated position thereby promoting an efficient layout of components on the mother board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card edge connector assembly mounted on a mother board, comprising:

a dielectric bracket having a center wall, a pair of side walls and a pair of top plates, a first receiving space and a second receiving space being defined between the side walls on opposite sides of the center wall;

a first card edge connector horizontally received in the first receiving space; and a second card edge connector horizontally received in the second receiving space;

wherein the first and second card edge connectors are distanced from the mother board, in each receiving space, each side wall defining a groove having a wide portion and a narrow portion for guidingly retaining the first and second card edge connectors, each card edge connector having an elongate housing including two opposite ends snugly received in the wide portion of the groove and a pair of engagement projections extending rearwardly from the two opposite ends to be inserted in the narrow portion of the groove.

2. The card edge connector assembly as claimed in claim 1, wherein at least one resilient hook is formed in each top plate, a corresponding number of recesses is defined in a top of the housing of each card edge connector for engaging the at least one hook of the top plate.

3. The card edge connector assembly as claimed in claim 1, wherein a polarizing post extends downwardly from the center wall for guiding the bracket to mount on the mother board.

4. The card edge connector assembly as claimed in claim 1, wherein at least one boardlock is provided in each side wall of the dielectric bracket for securing the card edge connector assembly to the mother board.

5. An card edge connector assembly comprising:

a first card edge connector horizontally positioned at an upper level and defining a first mating slot facing to a first direction, said first card edge connector further including a plurality of terminals with vertically extending tails thereof;

a second card edge connector horizontally positioned at a lower level and defining a second mating slot facing to a second direction opposite to said first direction, said second card edge connector further including a plurality of terminals with vertically extending tails thereof;

said tails of the first terminals and of the second terminals being positioned between said first mating slot and said second mating slot; and a bracket defining back to back first and second receiving spaces; wherein said first card edge connector is horizontally installed into the first receiving space along the second direction while the second card edge connector is horizontally installed into the second receiving space along the first direction.

6. The connector assembly as claimed in claim 5, wherein the bracket includes an upper first top plate and a lower second top plate, and said first connector and said second connector are respectively positioned thereunder.

7. The connector assembly as claimed in claim 5, wherein the bracket includes means for horizontally installing the connectors thereto.

8. The connector assembly as claimed in claim 5, wherein the bracket includes means for retaining the connectors in position thereto.

9. The connector assembly as claimed in claim 5, wherein said bracket includes a center wall positioned between and segregating said two connectors.

10. The connector assembly as claimed in claim 5, wherein said first connector and said second connector are further offset from each other in a vertical direction.

* * * * *